US005115583A

United States Patent [19]

Vail

[11] Patent Number: 5,115,583

[45] Date of Patent: May 26, 1992

[54] AUXILIARY RIPPER TOOTH FOR BACKHOE

[76] Inventor: Donald E. Vail, Rte. 190 3, Box 222, Enid, Okla. 73703

[21] Appl. No.: 723,793

[22] Filed: Jul. 1, 1991

[51] Int. Cl.[5] ..... E02F 9/28

[52] U.S. Cl. ..... 37/103; 37/118 R; 37/141 T; 37/142 R; 37/DIG. 3; 37/DIG. 12

[58] Field of Search ..... 37/117.5, 142 R, 141 T, 37/141 R, DIG. 3, DIG. 12, 118 R, 103

[56] References Cited

U.S. PATENT DOCUMENTS 3,596,996 8/1971 Carter ..... 37/117.5 X
4,041,624 8/1977 Fryrear ..... 37/117.5
4,204,348 5/1980 Lydie ..... 37/117.5
4,327,509 5/1982 Bean ..... 37/117.5
4,531,883 7/1985 Arnold ..... 37/117.5 X
4,561,199 12/1985 Lockwood ..... 37/117.5
4,595,240 6/1986 Pettersson ..... 37/117.5 X

*Primary Examiner*—Dennis L. Taylor
*Assistant Examiner*—J.Russell McBee
*Attorney, Agent, or Firm*—Laney, Dougherty, Hessin & Beavers

[57] ABSTRACT

An auxiliary ripper tooth for attachment to a backhoe fitted with a quick coupler linkage, which ripper tooth includes an elongated, arcuate shank having a point at one end and a bifurcation at the opposite end. An apertured lobe forms one of the furcations or branches at the bifurcated end, and receives a transversely extending pivotal mounting sleeve. The other furcation or branch has an impact bar secured thereto and extending transversely thereacross at a location to bear against a broad impact surface on the quick coupler linkage.

6 Claims, 2 Drawing Sheets

AUXILIARY RIPPER TOOTH FOR BACKHOE

FIELD OF THE INVENTION

This invention relates to an auxiliary ripper tooth which can be attached to a backhoe for the purpose of scarifying or digging in the earth with a penetrating tine action, which tooth can be used alternately to, or even at the same time as, the backhoe bucket for loosening soil to be picked up by the backhoe.

BACKGROUND OF THE INVENTION

Brief Description Of The Prior Art

It has been previously proposed to pivotally secure a ripper tooth to the back side of a backhoe in a position such that the tooth can penetrate into the soil, particularly at a time when the backhoe is tucked or folded upwardly. The ripper tooth carries a sharp point cap and this enables it to slice deeply into the ground, or even through hard material in the soil. By reason of the pivotal mounting of the tooth on the backhoe, it can be pivoted about a horizontal axis to an operative position in which the point extends downwardly and slightly forward at a time when the bucket carrying the tooth at its rear side is tucked upwardly in a stored or inactive position by the use of hydraulic cylinders and in a conventional fashion.

The ripper tooth carries a small aperture through the tooth which permits it to be pinned between a pair of ears secured to the rear side of the backhoe at a time when it is desired to keep the digger tooth in an inoperative juxtaposition relative to the backhoe.

One of the problems with the described tooth of the prior art is the manner in which a load is transmitted through the ripper tooth to its pivotal axis on the backhoe, and to a blunt end formed on the top side of the ripper tooth at a location above the pivotal axis where the top of the tooth contacts the bucket of the backhoe. It has been found that the hard metal of the ripper tooth at this blunt end location can wear into and damage the backhoe, per se, and particularly, an appended coupling linkage which has been developed recently by a backhoe manufacturer to permit the backhoe arm to be quickly engaged and disengaged with backhoe buckets of differing sizes.

BRIEF DESCRIPTION OF THE PRESENT INVENTION

The present invention is an auxiliary ripper tooth for pivotal attachment to a backhoe for supplementing and complementing the digging action of the bucket of the backhoe The tooth swings freely from the back side of the backhoe about a horizontal pivotal axis, and is moved by gravity into an effective digging position at a time when the backhoe is tucked upwardly to an inoperative position. On some occasions, the ripper tooth can be used concurrently with the backhoe in excavation operations.

Broadly described, the ripper tooth of the invention includes an elongated, arcuate shank which has a pair of opposite ends. One of the ends is narrowed and is adapted to fit into a ribbed digging tip or point sleeve which extends to a sharp point. The opposite end of the shank is bifurcated or forked, thus having a pair of divergent furcations or branches. One furcation or branch is a large, rounded lobe which has an opening formed therethrough for the purpose of receiving a transversely extending pivotal mounting sleeve. The transversely extending pivotal mounting sleeve facilitates the pivotal mounting of the digger tooth o the backside of a backhoe bucket as hereinafter described. The other furcation or branch at the end of the shank has a notch therein which receives an elongated impact bar. The impact bar is sized and positioned for impacting against an impact surface carried on a quick coupler linkage mounted on the backhoe.

An important object of the invention is to provide an auxiliary ripper tooth for a backhoe in which the ripper tooth pushes against, and transfers a major portion of reaction load of digging, to the strongest part of a coupler linkage.

A further object of the invention is to provide an auxiliary ripper tooth which can be very quickly and easily attached to, or detached from, the back side of a backhoe bucket.

GENERAL DESCRIPTION OF THE DRAWINGS

DETAILED DESCRIPTION OF A PREFERRED EMBODIMENT OF THE INVENTION

Figure 1:
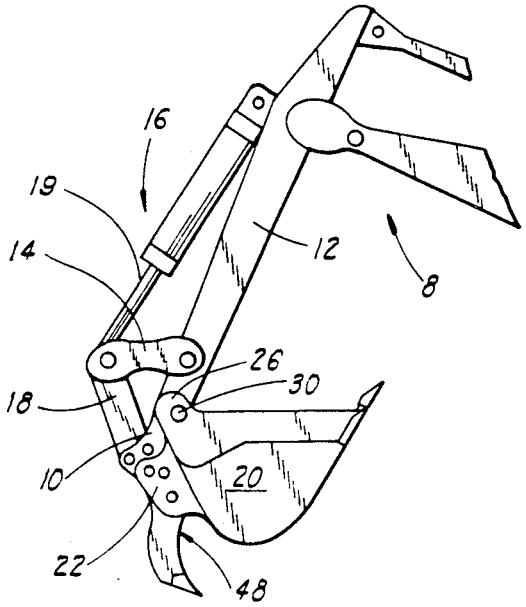
FIG. 1 is a side elevation view of the auxiliary ripper tooth of the invention as it appears when pivotally attached to a backhoe bucket which is secured to the actuating arm of the backhoe by means of a quick coupler linkage which permits the backhoe arm to be coupled to differing sizes of buckets as may be needed or desirable.

Referring initially to FIG. 1 of the drawings, shown therein is a backhoe structure 8 with various parts thereof illustrated, including a quick coupler linkage 10, and a backhoe boom 12. The backhoe further includes a cross link 14, a hydraulic piston and cylinder subassembly, designated generally by reference numeral 16, and a connecting link 18. The connecting link 18 is connected between the end of the piston rod 19 of the piston and cylinder subassembly 16 and the quick coupler linkage 110. The backhoe 8 further includes a bucket 20 having a pair of spaced, substantially parallel coupling plates 22 and 24 secured to the back side of the bucket and projecting rearwardly therefrom.

The backhoe bucket 20 also carries a pair of upwardly and rearwardly projecting apertured lug plates 26 and 28. The lug plates 26 and 28 function to receive an elongated pivot pin 30 which passes through aligned apertures in the lug plates 26 and 28 and through a sleeved opening 32 formed through the upper end of the quick coupler linkage 10 (see FIG. 6).

Figure 6:
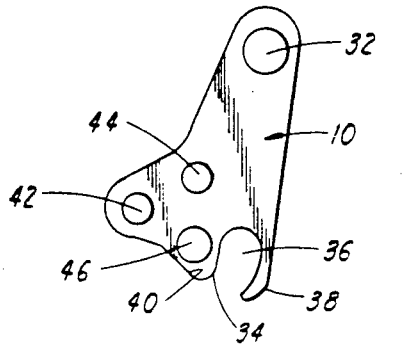
FIG. 6 is a side elevation view of the quick coupler linkage utilized on backhoes to which the digger tooth of the present invention is pivotally connected.

The quick coupler linkage 10 is illustrated in FIG. 6 and is pivotally pinned to the backhoe bucket 20 at the illustrated location in order to permit different sizes of buckets to be interchangeably connected to the hydraulically operated linkage of the backhoe after mounting on the lower end of the backhoe boom 12. The quick coupler linkage 10 includes a transversely extending impact surface 34 as shown in FIG. 6. A deep recess 36 is formed between a lip 38 and an apertured lobe 40 formed on the end of the quick coupler linkage 10 as shown in FIG. 6. A plurality of apertures 42, 44 and 46 are formed through the apertured lobe 40 of the quick coupler linkage 10 at the location illustrated in FIG. 6.

The auxiliary ripper tooth of the present invention is denominated generally by reference numeral 48. The ripper tooth includes an elongated arcuate shank 50 which has a first end 52. The shank is a flat plate having a concavely curved forward edge and a convexly curved rear edge. The first end 52 narrows as illustrated in dashed lines in FIG. 5 so that a pointed cap 54 can be placed over this end and pinned thereto. The digging tip or pointed sleeve 54 has a hollow interior and carries a reenforcing rib 56 on the lower rear side thereof. The digging tip or pointed cap 54 can be replaced when it becomes excessively worn.

At its opposite end, the elongated arcuate shank 50 is bifurcated or forked and thus has a pair of divergent furcations or branches at this opposite or second end of the shank. One furcation or branch is a large rounded lobe 58 which has an aperture 60 formed therethrough accommodating a cylindrical sleeve 61. This facilitates the mounting of the auxiliary ripper tooth on a large pivot pin or rod 62 which extends through the sleeve 61 and aperture 60 in the lobe 58 in the manner shown in FIG. 7.

Figure 5:
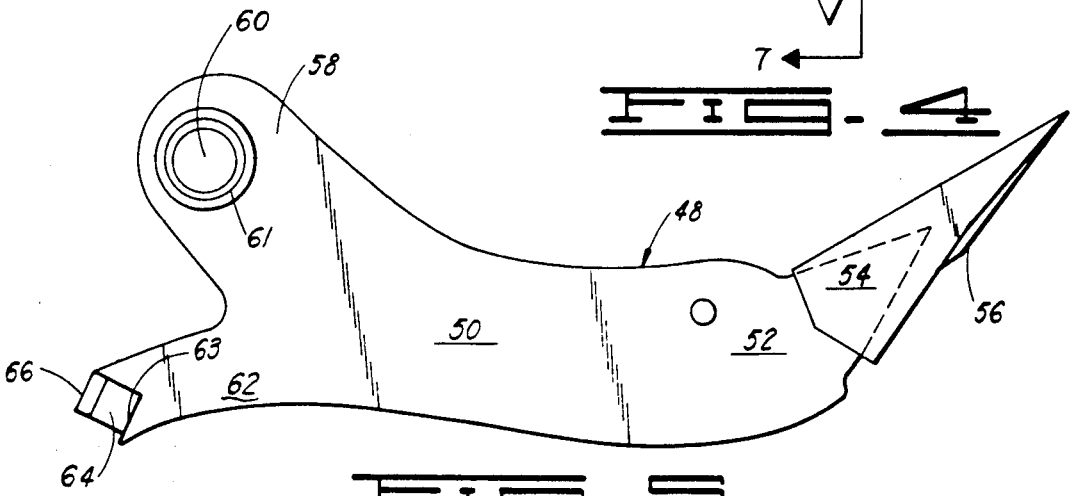
FIG. 5 is an enlarged, side elevation view of a ripper tooth constructed in accordance with the present invention.
Figure 8:
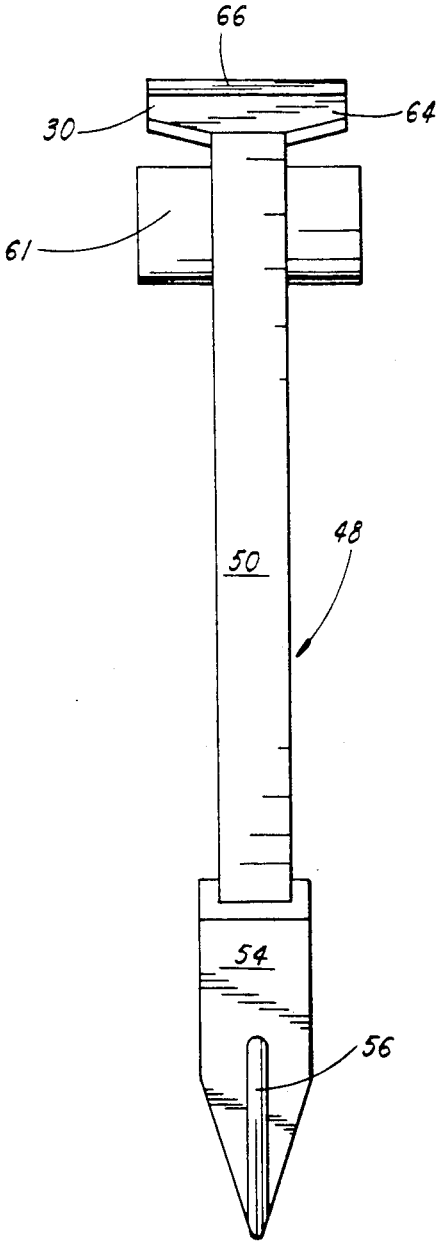
FIG. 8 is a rear elevation view of the digger tooth of the invention.

The other of the two furcations or branches 62 defines a notch 63 which is of generally right angular configuration and functions as a seat for receiving an elongated impact bar 64. The impact bar 64 has an impact surface 66 positioned as shown in FIGS. 5 and 8 so as to extend substantially parallel to the pivotal axis of the ripper tooth about the pivot pin 62 which is passed through the opening or aperture 60 by means of the surrounding elongated cylindrical sleeve 61.

Figure 4:
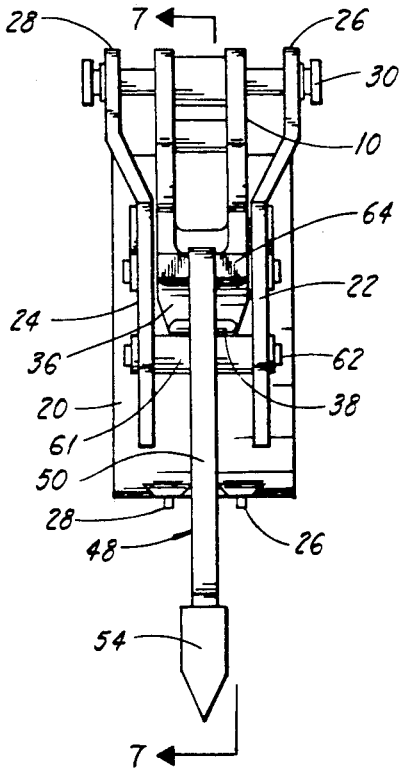
FIG. 4 is a view in rear elevation of the ripper tooth as it appears when it is extending downwardly in its digging position, and with the impact block carried at the upper, bifurcated end of the shank of the digger tooth bearing against an impact surface formed on a quick coupler linkage utilized on backhoes upon which the ripper tooth of the present invention is mounted.

As will be perceived, when reference is made to FIG. 4, the ripper tooth 48 is mounted on the backhoe bucket by extending a suitable pivot pin 62 through pair of aligned apertures in the two spaced, substantially parallel coupling plates 22 and 24 and through the sleeve 61 and opening aperture 60 through the large lobe 58 at one end of the arcuate shank 50. The ripper tooth is thus pivotally mounted for pivotation about an axis which extends parallel to the axis of pivotation of the bucket 20. As the ripper tooth swings or pivots about the pin 62, it tends to be moved by gravity into the position depicted in FIG. 1. When it is inoperative, it can also be pinned against the back side of the backhoe bucket 20 by means of the rearwardly projecting apertured lug plates 26 and 28.

Figure 7:
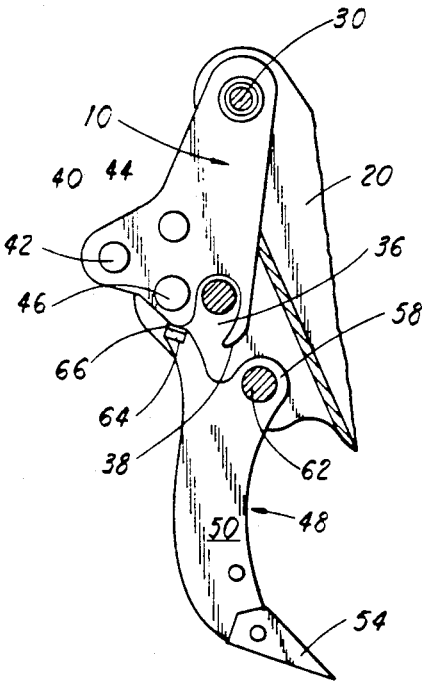
FIG. 7 is an enlarged detail view similar to Figure !, but having parts of the backhoe bucket removed, and having a part of the hydraulic linkage disconnected from the quick connect linkage utilized in conjunction with the ripper tooth of the present invention.

It will be noted in referring to FIG. 7 that at a time when the ripper tooth 48 extends downwardly by gravity into its operating or ripping position, it is pivoted upwardly about the pivot pin 62 until the impact bar 64 moves to a position where the impact bar surface 6 impacts against the transversely extending impact surface 34 carried on the coupler linkage 110. The way in which the coupler linkage 10 is used to attach various backhoe buckets to the backhoe apparatus, the impact surface 66 on the impact bar 64 carried on the ripper tooth 48 will always bang against, or impact on, the transversely extending impact surface 34 which is a relatively broad surface on the coupler linkage 10 so that this impact force is spread over a large surface area, and hits against a relatively hard metal area so that there is little wear or abrasion over an extended period of time.

Figure 2:
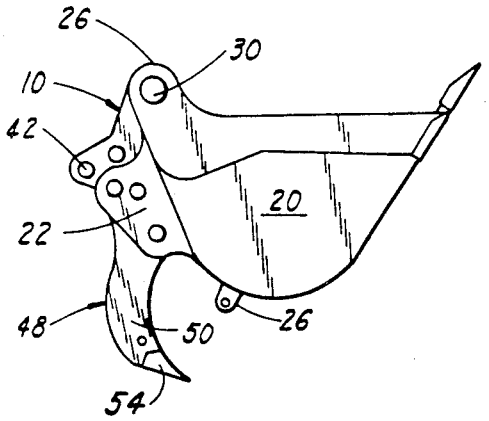
FIG. 2 is a view similar to FIG. 1, but illustrating a pair of ears secured to the rear of the bucket for pinning the ripper tooth against the rear side of the bucket when it is desired to prevent it from pivoting up and down relative to the bucket.

As previously pointed out, the ripper tooth 48 of the invention can be used alone for digging when it is in the position relative to the backhoe bucket 2 which is depicted in FIGS. 1 and 2. It can also be used concurrently with the bucket so that both accomplished digging functions simultaneously, and this occurs at a time when the bucket 20 is lowered from the tucked or raised position depicted in Figures 1 and 2 to a digging position slightly below that, but not sufficiently low so as to interfere with the chiseling action of the ripper tooth 48.

Figure 3:
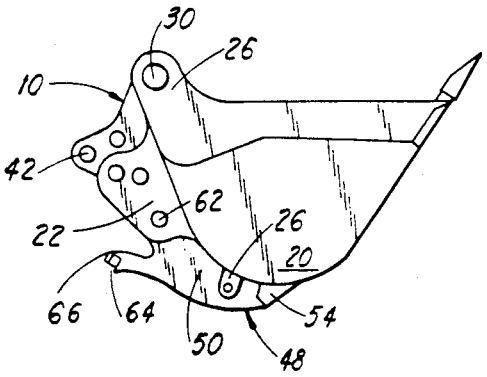
FIG. 3 is a view illustrating another part of the auxiliary ripper tooth which can be seen at a time when the tooth is pinned to the backside of the backhoe bucket in an inoperative position.

When the backhoe bucket 20 is to be used alone and it is not desired to have the ripper tooth pivoting freely so as to bang against the bucket and against the impact surface 34 of the quick coupler linkage 110, the ripper tooth is pinned between the pair of rearwardly projecting apertured lug plates 26 and 28 with a suitable pin which is extended through apertures in these lug plates in the manner illustrated in FIG. 3.

The auxiliary chisel tooth of the present invention has been found to wear well and to cause little damage to the remainder of the apparatus as a result of banging of the impact surface 66 provided on the ripper tooth against a surface of the quick coupler linkage 10. In this respect, the ripper tooth of the present invention is an improvement over those which have been known to the prior art.

Although a preferred embodiment of the invention has been herein described in order to afford an opportunity for those skilled in the art to practice the invention from the description of the invention set forth herein, it is to be understood that various changes in the depicted and described structure can be made without exceeding the fair limits and range of equivalents of the invention, as literally defined in the claims. Changes and innovations of that type are therefore deemed to be circumscribed by the spirit and scope of the invention, except as the same may be necessarily limited by the appended claims or reasonable equivalents thereof.

What is claimed is:

1. An auxiliary ripper tooth for pivotal attachment to a backhoe bucket comprising:

an elongated, arcuate shank having a first end and a bifurcated second end having two branches, and having a bifurcation between said two branches;

a digging point element on said first end;

a lobe defining an opening spaced from said first end for pivotally supporting said shank on a bucket for pivotation about a substantially horizontally extending axis, and said lobe forming one of said two branches of the bifurcation at the second end of said shank;

a second branch of said two branches off of said lobe and defining a notch in one side thereof, said second branch and said lobe having said bifurcation therebetween; and an elongated, transversely extending impact bar secured in said notch at substantially the midpoint of said bar and extending substantially parallel to said substantially horizontally extending axis, said impact bar having an elongated impact surface extending along one side thereof from one end thereof to the other and said impact bar moving with said shank during the pivotal movement of said shank.

2. An auxiliary ripper tooth for pivotal attachment to a backhoe bucket as defined in claim 1 wherein said shank defines a hole therethrough to permit said ripper tooth to be pinned against the back of a backhoe bucket.

3. An auxiliary ripper tooth for pivotal attachment to a backhoe bucket as defined in claim 1 and further characterized as including an elongated cylindrical sleeve projecting through the opening in said lobe in a transverse direction for receiving a pivot pin by which said ripper tooth is pivotally mounted on said bucket.

4. An auxiliary ripper tooth for pivotal attachment to a backhoe bucket as defined in claim 1 wherein said digging point element is removably mounted on said first end.

5. An auxiliary ripper tooth for pivotal attachment to a backhoe bucket as defined in claim 3 wherein said digging point element is removably mounted on said first end.

6. In combination in a backhoe structure:

an elongated backhoe boom;

a backhoe bucket pivotally connected to said boom and including an open side and a back side;

a quick coupler linkage connected to said backhoe bucket and including an elongated impact surface carried thereon;

a hydraulic piston and cylinder subassembly carried on said boom and connected to said linkage for pivoting the bucket when said piston and cylinder subassembly is actuated; and an auxiliary ripper tooth pivotally connected to the back side of said bucket for pivotation about a substantially horizontally extending pivotal axis, said ripper tooth comprising:

an elongated, arcuate shank having a first end and a bifurcated second end having two branches, and having a bifurcation between said two branches;

a digging point element on said first end;

a lobe defining an opening for pivotally supporting said shank on said bucket for pivotation about a substantially horizontally extending axis, and said lobe forming one of said two branches of the bifurcation at the second end of said shank;

a second branch of said two branches branching off of said lobe and defining a notch in one side thereof, said second branch and said lobe having said bifurcation therebetween; and an elongated, transversely extending impact bar secured in said notch at substantially the midpoint of said bar and extending substantially parallel to said substantially horizontally extending axis, said impact bar having an elongated impact surface extending along one side thereof from one end thereof to the other and said impact bar moving with said shank during the pivotal movement of said shank.

* * * * *

UNITED STATES PATENT AND TRADEMARK OFFICE

CERTIFICATE OF CORRECTION

PATENT NO. : 5,115,583

DATED : May 26, 1992

INVENTOR(S) : Donald E. Vail

It is certified that error appears in the above-indentified patent and that said Letters Patent is hereby corrected as shown below:

On the Abstract Page

In the inventor's address delete "190" right before the numeral 3.

In Column 2, line 2, delete "o" and insert -on-.

In Column 2, line 40, delete the period "." after the word "upper" and insert a comma -,-.

In Column 3, line 1, delete "110" and insert -10-.

In Column 3, line 58, after the word "through" insert -a-.

In Column 4, line 7, delete "6" and insert -66-.

In Column 4, line 9, delete "110" and insert -10-.

In Column 4, line 22, delete "2" and insert -20-.

In Column 4, line 33, delete "110" and insert -10-.

In the Claims:

In Column 5, line 3, after the word "branches" insert -branching-.

In Column 6, line 12, delete the period "." after the word "axis" and insert a comma -,-.

In Column 6, line 26, delete the period "." after the word "thereof" and insert a comma -,-.

In Column 6, line 32, delete the period "." after the word "axis" and insert a comma -,-.

Signed and Sealed this

Twenty-fourth Day of August, 1993

Bruce Lehman

*Attest:*

BRUCE LEHMAN

*Attesting Officer*

*Commissioner of Patents and Trademarks*